US006686686B1

(12) United States Patent
Firester et al.

(10) Patent No.: US 6,686,686 B1
(45) Date of Patent: Feb. 3, 2004

(54) BI-POTENTIAL ELECTRODE SPACE-SAVING CATHODE RAY TUBE

(75) Inventors: Arthur Herbert Firester, Skillman, NJ (US); Dennis John Bechis, Yardley, PA (US); Joseph Michael Carpinelli, Lawrenceville, NJ (US); George Herbert Needham Riddle, Princeton, NJ (US)

(73) Assignee: Sarnoff Corporation, Princeton, NJ (US)

( * ) Notice: Subject to any disclaimer, the term of this patent is extended or adjusted under 35 U.S.C. 154(b) by 495 days.

(21) Appl. No.: 09/692,733

(22) Filed: Oct. 19, 2000

Related U.S. Application Data

(60) Provisional application No. 60/160,654, filed on Oct. 21, 1999.

(51) Int. Cl.[7] ..... H01J 29/50
(52) U.S. Cl. ..... 313/409
(58) Field of Search ..... 313/409, 415, 313/449, 479

(56) References Cited

U.S. PATENT DOCUMENTS

| | | | | |
|---|---|---|---|---|
| 2,798,185 A | | 7/1957 | Hansen et al. | |
| 2,864,032 A | | 12/1958 | Amdursky et al. | |
| 2,981,864 A | | 4/1961 | Burdick et al. | |
| 3,005,921 A | | 10/1961 | Godfrey | |
| 3,185,879 A | | 5/1965 | Evans | |
| 3,683,224 A | | 8/1972 | Lea | |
| 3,792,300 A | * | 2/1974 | Benda et al. | 313/439 |
| 4,323,816 A | | 4/1982 | Chang | |
| 4,329,618 A | | 5/1982 | Chang | |
| 4,543,508 A | * | 9/1985 | Saito | 313/429 |
| 4,977,348 A | * | 12/1990 | Odenthal | 313/479 |
| 5,327,044 A | | 7/1994 | Chen | |
| 5,357,176 A | | 10/1994 | Nishio et al. | |

FOREIGN PATENT DOCUMENTS

| | | |
|---|---|---|
| DE | 42 20 964 A | 1/1993 |
| GB | 652 267 A | 4/1951 |
| WO | WO 00/67286 A | 11/2000 |
| WO | WO 00/67287 A | 11/2000 |
| WO | WO 00/67288 A | 11/2000 |

OTHER PUBLICATIONS

PCT Application, PCT/US00/28927, Written Opinion, Dated Apr. 1, 2002, 5 pages.
International Search Report, PCT/US00/28927, Feb. 6, 2001, (3 Pages).

* cited by examiner

*Primary Examiner*—Sandra O'Shea
*Assistant Examiner*—Sumati Krishnan
(74) *Attorney, Agent, or Firm*—William J. Burke

(57) ABSTRACT

A plural-beam cathode ray tube includes an electron gun directing electrons towards a faceplate having an electrode biased at screen potential. The electron beam is magnetically deflected to scan across the faceplate to impinge upon a pattern of phosphors thereon to produce light of different colors depicting an image. A first conductive coating near the tube neck is biased below screen potential and a second conductive coating between the neck electrode and the faceplate is biased at screen potential. A gap between the first and second conductive coatings varies in distance from the faceplate so as to be non-Z-planar. The non-Z-planar gap is preferably partly within the region wherein electrons are deflected by the magnetic deflection yoke and partly more proximate the faceplate than such deflection region.

33 Claims, 6 Drawing Sheets

BI-POTENTIAL ELECTRODE SPACE-SAVING CATHODE RAY TUBE

This Application claims the benefit of U.S. Provisional Application No. 60/160,654 filed Oct. 21, 1999, and of U.S. patent application Ser. No. 09/559,809 filed Apr. 26, 2000.

The present invention relates to a cathode ray tube and, in particular, to a cathode ray tube including a deflection aiding electrostatic field.

Conventional cathode ray tubes (CRTs) are widely utilized, for example, in television and computer displays. One or more electron guns positioned in a neck of a funnel-shaped glass bulb of a CRT direct a corresponding number of beams of electrons toward a glass faceplate biased at a high positive potential, e.g., 30 kilovolts (kV). The faceplate usually has a substantially rectangular shape and is generally planar or slightly curved. Together, the glass bulb and faceplate form a sealed enclosure that is evacuated. The electron gun(s) are positioned along an axis that extends through the center of the faceplate and is perpendicular thereto.

The electron beam(s) is (are) raster scanned across the faceplate so as to impinge upon a coating or pattern of phosphors on the faceplate that produces light responsive to the intensity of the electron beam, thereby to produce an image thereon. The raster scan is obtained by a deflection yoke including a plurality of electrical coils positioned on the exterior of the funnel-shaped CRT near the neck thereof. Electrical currents driven in first coils of the deflection yoke produce magnetic fields that cause the electron beam(s) to deflect or scan from side to side (i.e. horizontal scan) and currents driven in second coils of the deflection yoke produce magnetic fields that cause the electron beam(s) to scan from top to bottom (i.e. vertical scan). The magnetic deflection forces typically act on the electrons of the beam(s) only in the first few centimeters of their travel immediately after exiting the electron gun(s), and the electrons travel in a straight line trajectory thereafter, i.e through a substantially field-free drift region. Conventionally, the horizontal scan produces hundreds of horizontal lines in the time of each vertical scan to produce the raster-scanned image. U.S. Pat. No. 5,327,044 to Chen entitled "Electron Beam Deflection Lens for CRT" describes a single-electron-gun monochrome cathode ray tube in which a resistive coating 54 in the tube neck and funnel portion 62a, 62b is biased to a potential less than screen potential and contacts a second coating G4 on the interior of the tube funnel and the screen 48 that is biased at screen potential. Chen is not seen to provide any description or suggestion regarding any plural-beam or color CRT.

The depth of a CRT, i.e. the distance between the faceplate and the rear of the neck, is determined by the maximum angle over which the deflection yoke can bend or deflect the electron beam(s) and the length of the neck extending rearward to contain the electron gun. Greater deflection angles provide reduced CRT depth.

Modern magnetically-deflected color (i.e. plural beam) CRTs typically obtain a ±55° deflection angle, which is referred to as 110° deflection. However, such 110° CRTs for screen diagonal sizes of about 62 cm (about 25 inches) or more are so deep that they are almost always provided in a cabinet that either requires a special stand or must be placed on a floor. For example, a 110° CRT having a faceplate with an about 100 cm (about 40 inch) diagonal measurement and a 16:9 aspect ratio, is about 60–65 cm (about 24–26 inches) deep. Practical considerations of increasing power dissipation producing greater temperature rise in the magnetic deflection yoke and its drive circuits and of the higher cost of a larger, heavier, higher-power yoke and drive circuitry make increasing the maximum deflection angle so as to decrease the depth of the color CRT disadvantageous.

Accordingly, there is a need for a plural beam cathode ray tube having either a greater deflection angle without an excessive increase in deflection power or the same deflection angle at a reduced deflection power, i.e. as compared to a conventional color CRT having an equivalent screen-size.

To this end, the plural-beam tube of the present invention comprises a tube envelope having a faceplate and a screen electrode on the faceplate adapted to be biased at a screen potential, a source of at least two beams of electrons directed toward the faceplate and adapted for magnetic deflection of the beams of electrons, and phosphorescent material disposed on the faceplate for producing light in response to the beams of electrons impinging thereon. At least first and second electrostatic electrodes on an interior surface of the tube envelope define a non-Z-planar gap therebetween. The first electrode is proximate the source and adapted to be biased at a potential less than the screen potential, and the second electrode is between the first electrode and the screen electrode and is adapted to be biased at the screen potential.

According to another aspect of the invention, a display comprises a tube envelope having a faceplate and a screen electrode on the faceplate biased at a screen potential, a source within the tube envelope of a beam of electrons directed toward the faceplate, a deflection yoke proximate the source of a beam of electrons for magnetically deflecting the beam of electrons and defining a deflection plane, and phosphorescent material disposed on the faceplate for producing light in response to the beam of electrons impinging thereon. First and second electrostatic electrodes interior said tube envelope define a gap therebetween that intersects the deflection plane and is partly disposed on one side thereof and partly to the other side thereof. The first electrode is proximate the source of a beam of electrons and is biased at a potential less than the screen potential, and the second electrode is between the first electrode and the screen electrode and is biased at the screen potential.

BRIEF DESCRIPTION OF THE DRAWING

The detailed description of the preferred embodiments of the present invention will be more easily and better understood when read in conjunction with the FIGS. of the Drawing which include.

Figure 1A:
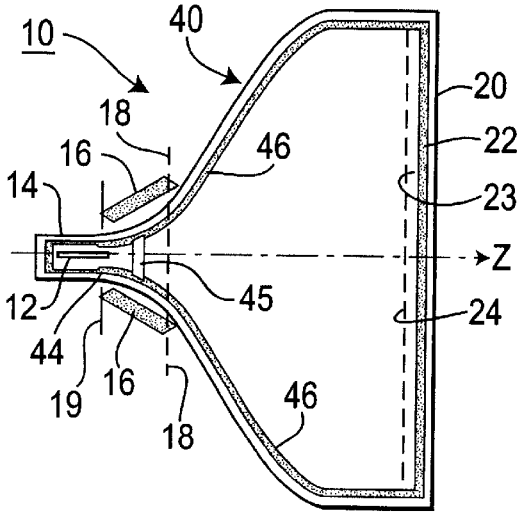
FIGS. 1A and 1B are cross-sectional schematic diagrams of exemplary cathode ray tubes helpful in understanding the present invention.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on. As is customary, the figures are not to scale and portions thereof maybe exaggerated for clarity of illustration

DESCRIPTION OF THE PREFERRED EMBODIMENTS

In a conventional color CRT, the electrons are at the screen or anode potential at the time they leave the electron gun and, other than for the deflection action of the dynamic magnetic deflection field, travel in straight lines to the screen or faceplate thereof. Such color cathode ray tube may find application, for example, in television displays, computer displays, projection tubes and other applications where it is desired to provide a color visual display. Electrons of the electron beam(s) are not further deflected after leaving the influence of the magnetic deflection yoke, i.e. in what is referred to as the "drift region" of a conventional color CRT through which the electrons travel in substantially straight lines.

A plural-beam cathode ray tube 10 according to the present invention, e.g., a color cathode ray tube, includes a faceplate 20, screen electrode 22, tube funnel 40, electron gun 12 in tube neck 14 and a deflection yoke 16 similarly to a conventional color cathode ray tube. Deflection yoke 16 produces dynamic scanning magnetic fields that have influence on the electron beams in a deflection region substantially lying between a forward plane 18 at the forward (toward the screen 22) end of the deflection yoke 16 and a rearward plane 19 at the rearward (toward the electron gun 12) end of the deflection yoke 16, to scan the electron beams across faceplate 20, e.g., in a raster scan fashion.

Cathode ray tube 10 includes a three beam electron gun 12 in tube neck 14 generally symmetrically located substantially at the center of tube funnel 40 to direct three beams of electrons 30 towards faceplate 20 which includes a screen electrode 22 biased at a relatively high positive potential. Faceplate 20 and the forward end of tube funnel 40 are generally rectangular in shape and of similar size and are joined by an annular end plate 48 to form a sealed container that can be evacuated. Deflection yoke 16 surrounds tube neck 14 in the region of its juncture with tube funnel 40 for magnetically deflecting electrons generated by gun 12 as they proceed out of gun 12 and toward faceplate 20 to impinge upon the phosphors 23 thereon.

Plural-beam tube 10 further includes conductive coatings in two regions on the interior of tube envelope 40. A first conductive coating 46 in a forward region includes the screen 22 and the tube funnel 40 extending rearward away from the screen 22, and is biased to screen potential. A second conductive coating 44 in a rearward region including at least part of tube neck 14 and the rearward portion of tube funnel 40 is biased at a potential below screen potential and is separated from first conductive coating 46 by an insulating interface or gap 45. Because the location of the insulating gap 45 in relation to the deflection yoke 16 has a pronounced effect on the deflection efficiency of the deflection yoke 16, the insulating gap 45 is disposed partly forward of the forward deflection plane 18 and partly rearward of the forward deflection plane 18. The glass envelope 40, 48 of a typical glass tube 10 will either closely follow or resemble the shape of a conventional CRT, but may be shorter in depth, and the combination of the conductive coatings 44, 46 and the bias potentials thereon beneficially tends to reduce the power required to drive magnetic deflection yoke 16.

Shadow mask 24 is spaced slightly apart from faceplate 20 and is attached thereto near their respective peripheries by a shadow mask mounting frame (not visible). Shadow mask 24 has a pattern of apertures through which plural electron beams 30 pass to impinge upon the pattern of color phosphors 23 on the inner surface of faceplate 20 to produce light to reproduce an image or information on faceplate 20 that is visible to a viewer. The conductive coating of screen 22 on the inner surface of faceplate 20 is electrically coupled to shadow mask 24 at the shadow mask mounting frame from which shadow mask 24 receives screen bias potential. In addition, an evaporable getter material, such as a barium getter material, may be mounted to the inner surface of glass bulb 40. The getter material is positioned so as to not coat any important insulating elements, e.g., the gap 45 isolating conductive coatings 44 and 46 or the insulating supports, if any, for electron gun 12.

Figure 1B:
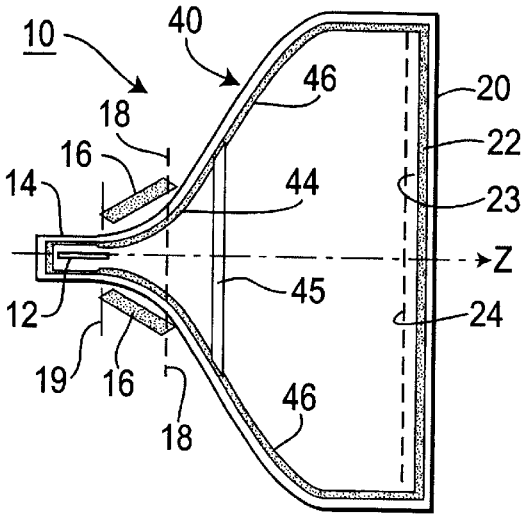

FIGS. 1A and 1B are cross-sectional diagrams of a plural-beam cathode ray tube 10 relating to the invention in its simplest form. It is noted that unless otherwise specified, such cross-sectional diagrams may be considered to illustrate either the horizontal or the vertical deflection orientation because both appear similar in such diagrams. One practical difference is that a typical tube for reproducing video images has a faceplate that is as viewed wider in the horizontal direction than it is high in the vertical direction, i.e. is positioned for viewing in a horizontal or so-called "landscape" format, although in certain applications such as dedicated word processing or publishing displays, the faceplate may be positioned for viewing in a vertical or so-called "portrait" format.

In exemplary plural-beam cathode ray tube 10 of FIGS. 1A and 1B, three beams of electrons produced by electron gun 12 located in tube neck 14 are directed towards faceplate 20 which includes a screen or anode electrode 22 which is biased at a relatively high positive potential and a pattern of three different phosphors 23 that emit three different colors of light in response to electrons impinging thereon to produce a color image. The electrons forming three electron beams 30 produced by electron gun 12 are deflected by magnetic fields produced by deflection yoke 16 to scan across the dimension of faceplate 20, such as in a conventional raster scan.

Conductive coating 46 on the interior surface of tube funnel 40 proximate faceplate 22 (e.g., generally forward of deflection yoke 16 in the direction of faceplate 20) is biased to the same relatively high positive potential as is screen electrode 22. Conductive coating 44 on the interior surface of tube funnel 40 distal faceplate 20 and proximal tube neck 14 (e.g., generally rearward of the forward deflection plane 18 and within the deflection region of deflection yoke 16 and extending rearward into tube neck 14) is biased to a positive potential that is less than the potential of screen electrode 22. Ultor of electron gun 12 is also biased to the lesser potential to which conductive coating 44 is biased for avoiding unusual electron-injection effects. Typically, flexible tabs connected to the ultor electrode also contact coating 44 to receive bias potential therefrom. Under the influence of electrostatic forces produced by the respective positive bias potentials of conductive coatings 44, 46 and the dynamic magnetic field produced by deflection yoke 16, the three beams of electron beam 30 are deflected over a total deflection angle in a raster scan fashion to impinge upon the patterned coating of three different phosphorescent materials 23 on faceplate 20 for producing a color display.

The electrostatic field produced by the positive less-than-screen-potential bias of conductive coating 44 surrounding the outlet of gun 12 in the vicinity of tube neck 14 results in the electrons of the electron beam 30 being relatively slower moving proximate yoke 16, and therefore more easily deflected by yoke 16, than if coating 44 were to be biased at screen potential. The result of the cooperation between electrode 44 and yoke 16 may be utilized to realize either a reduction of yoke power, and therefore a smaller, lighter, less expensive and likely more reliable deflection yoke 16, or a greater deflection angle with the same yoke and yoke power.

In particular, the location of gap 45 relative to deflection yoke 16, i.e. its position along the Z-axis of tube 10 in relation to the forward deflection plane 18, has been discovered to have a substantial effect on the "horizontal stored energy" required for deflection yoke 16 to produce a given raster scan. The horizontal stored energy (HSE) is a measure of the energy that must be stored in the magnetic field of the horizontal deflection coil(s) to produce the desired deflection to a given region, typically the edges or corners of faceplate 20. Typically, HSE is represented by:

$$HSE = C\ V_U(\text{Tan}\ \alpha)^N$$

where: C is a coefficient representative of certain fundamental constants and yoke geometry parameters, $V_U$ is the bias potential in the region of deflection and of the electron gun, $\alpha$ is the deflection angle, and N is a number between 1 and 2.

HSE is a parameter useful in evaluating yoke efficiency, and is generally proportionally related to the power required to drive the deflection yoke. HSE is representative because the horizontal scanning is at a much higher frequency than is the vertical scanning (e.g., about 15,575 Hz vs. about 60 Hz.), and also because the horizontal deflection angle is greater than the vertical deflection angle in a typical horizontal format CRT.

For example, in the exemplary plural-beam tube 10 of FIG. 1A, the interface or gap 45 between lower-potential coating 44 and screen-potential coating 46 is displaced along the Z axis in the direction away from faceplate 20 and towards tube neck 14 and electron gun 12 so as to be rearward of the forward deflection plane 18. The resulting HSE is designated as HSE-1A and lies along HSE characteristic 99 in FIG. 2 which graphically represents the parameter HSE as a function of the position along the Z axis of gap 45 for deflection to a corner of faceplate 20. The HSE-0 reference level is the HSE for an equivalent geometry mono-potential CRT, i.e. a CRT in which the entire interior surface of tube envelope 40 is at screen potential. In this example, the electrons of the electron beams are within the field-free region of conductive coating 46 biased at screen potential and so are at their final or terminal velocity in the region where deflection occurs, whereby the yoke HSE is less than the HSE-0 reference level, but is only slightly less than HSE-0.

Similarly, in the exemplary plural-beam tube 10 of FIG. 1B, the interface or gap 45 between lower-potential coating 44 and screen-potential coating 46 is displaced along the Z axis in the direction toward faceplate 20 and away from tube neck 14 and electron gun 12 so as to be forward of the forward deflection plane 18. The resulting HSE is designated as HSE-1B along HSE characteristic 99 in FIG. 2. In this example, the electrons of the electron beams are within the electric field region of conductive coating 44 biased at a potential well below screen potential and so are moving at well below terminal velocity in the region where deflection occurs, whereby the yoke may be either less effective or more effective than is the case for the HSE-0 reference level for an equivalent geometry mono-potential CRT. In the particular example illustrated, gap 45 happens to be too far forward towards faceplate 20 and so the yoke HSE-1B is slightly higher than the HSE-0 level. In fact, there is a range of gap 45 positions within the relatively large region in which the electrons of the electron beams are accelerated toward the faceplate 20 under the influence of the screen bias potential. This acceleration tends to offset the deflection by yoke 16. Thus, either little reduction or an increase of HSE may result.

At positions of gap 45 intermediate those of the foregoing examples, HSE decreases and exhibits a minimum value HSE-1, so that there is a position of gap 45 along the Z axis direction of tube 10 at which the required yoke effort HSE represented by HSE characteristic 99 tends to be minimized or deflection yoke 16 tends to be optimal. The HSE characteristic 99 for a particular size and geometry tube may be calculated using conventional CRT analysis including but not limited to computer simulation.

Figure 2:
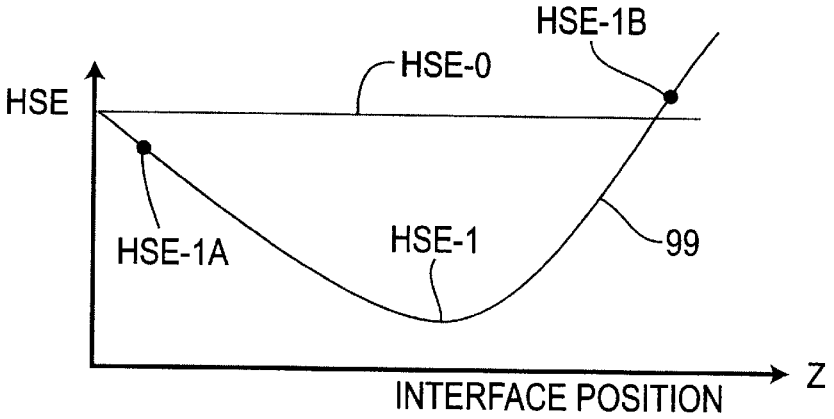
FIG. 2 is a graphical representation of a measure of deflection energy for a cathode ray tube including the exemplary cathode ray tubes of FIGS. 1A and 1B.

Characteristic 99 for deflection to a corner of faceplate 20 of the graph of FIG. 2 is somewhat simplified, however, because HSE is also a function of the particular deflection position of the electron beams 30, e.g., to a corner of faceplate 20. Ordinarily, deflection yoke 16 produces a certain amount of pincushion whereby deflection to either the right or left edge locations of screen 22 on faceplate 20 (i.e., the 3:00 and 9:00 o'clock positions) require the highest HSE of any beam landing location, and deflection to the corners (top or bottom) of screen 22 on faceplate 20 (i.e. the about 2:00, 4:00, 8:00 and 10:00 positions) requires the lowest HSE for a beam landing location on the periphery of screen 22. As a result, there are different positions of gap 45 that are at the minimum of the characteristic 99 for different beam landing locations.

Accordingly, it is preferred that the shape of gap 45 defining the boundary between the relatively lower potential region of conductive coating 44 and the relative higher potential of conductive coating 46 not be in a single plane perpendicular to the Z axis, but be shaped so as to be in the most desirable position in the Z axis direction for deflection to the side edges of screen 22 which require the highest HSE. Thus, it is preferred that the field produced by conductive coating 44 should extend towards screen 22 and so the location of gap 45 is preferably closest to screen 22, and is forward of the forward deflection plane 18, for affecting deflection of the three electron beams 30 to the side edges of faceplate 20 (i.e. to the 3:00 and 9:00 o'clock locations). To improve the linearity of deflection yoke 16 and to minimize needless electron-optic activity, the extent of the field produced by conductive coating 44 and thus the Z axis position of gap 45 should be further from screen 22 for deflection in directions other than to the side edges of screen 22, preferably being furthest from screen 22, and rearward of deflection plane 18, for deflection to the corners (i.e. to the about 2:00, 4:00, 8:00 and 10:00 o'clock locations).

Figure 3:
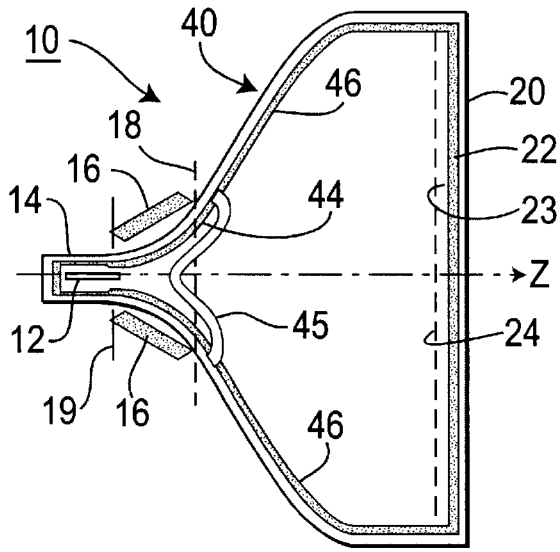
FIG. 3 is a cross-sectional schematic diagram of a plural beam cathode ray tube in accordance with the present invention.
Figure 4:
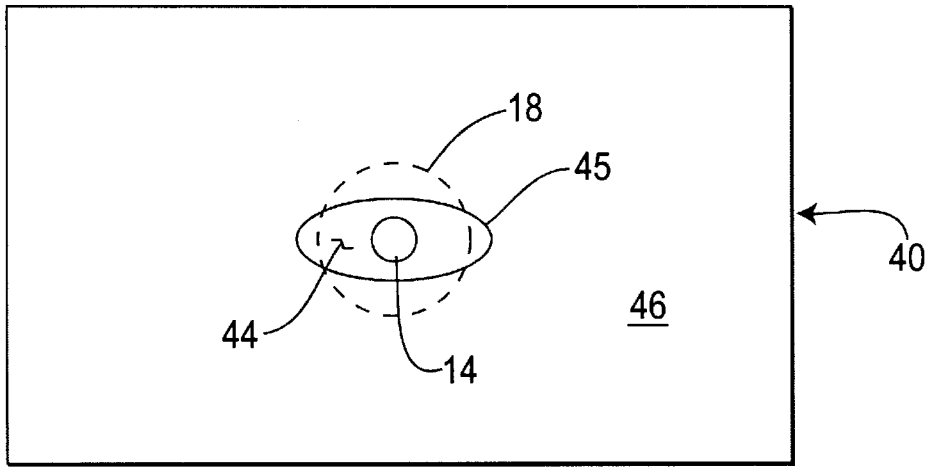
FIG. 4 is a cut-away front view sectional schematic diagram showing the interior of the tube funnel and yoke region of the exemplary cathode ray tube in accordance with the invention of FIG. 3.

FIG. 3 is a cross-sectional schematic diagram of a plural beam cathode ray tube 10 in accordance with the invention, and FIG. 4 is a cut-away front view sectional schematic diagram showing the interior of the tube funnel 40 and yoke region of the exemplary plural-beam cathode ray tube 10 of FIG. 3. Tube 10 includes a faceplate 20, screen 22, phosphors 23, tube funnel 40 having a neck 14, electron gun 12 and deflection yoke 16 as described above. Conductive coatings 44 and 46 are biased to potentials as described above and are separated by a shaped, non-Z-planar gap 45. The intersection of forward deflection plane 18 with tube funnel 40, which typically is of generally conical shape in the region near deflection yoke 16 with an apex rearward near tube neck 14, is illustrated by a dashed line 18 in FIG. 4. Conductive coatings 44, 46 provide first and second electrostatic electrodes interior the tube 10 envelope 40 defining a gap 45 that intersects forward deflection plane 18 and is partly disposed on one side thereof and partly to the other side thereof.

The shape of gap 45 when viewed from faceplate 20 is elongated, being generally wider in the horizontal direction and generally narrower in the vertical direction, thus appearing elliptical, although mathematically it may not be an ellipse. Conductive coating 44 is thus generally conical with an elongated open forward end proximal faceplate 20 and extending rearward to electron gun 12 in tube neck 14 distal faceplate 20. The forward end of conductive coating 44 extends forward and horizontally beyond forward deflection plane 18 toward screen 22. Conductive coating 46 is generally conical at its rearward end and generally rectangular at its forward end where it meets and connects to screen 22 with an elongated open rearward end distal faceplate 20 and extending forward to faceplate 20. The rearward end of conductive coating 46 extends rearward and vertically beyond forward deflection plane 18 away from screen 22. The particular shape of the elongated and non-Z-planar gap 45 is dependent upon the particular shape and bias potentials of tube 10. Apart from having mirror symmetry about both the X (horizontal) and Y (vertical) axes when viewed from faceplate 20 (as in FIG. 4), gap 45 could be another shape such as a "dog-bone" shape.

As used herein with respect to the gap 45 between conductive coatings 44, 46, "non-Z-planar" means a gap that does not lie in a plane perpendicular to the Z axis of the CRT (i.e. ignoring the width of the gap which is the spacing along tube funnel 40 between conductive coatings 44, 46). A non-Z-planar gap may be two dimensional or planar if it does not lie in a plane that is perpendicular to the Z axis of the tube 10 or may be three dimensional and so not lie in any plane. Non-Z-planar gap 45 is typically "four-fold" symmetric, i.e. it has mirror symmetry with respect to both the X (horizontal) axis and the Y (vertical) axis of tube 10. Even if the Z-axis cross-section of tube funnel 40 is circular in the region of gap 45, gap 45 will not be circular. While gap 45 is preferably of uniform width, e.g., typically in the range of 1–5 mm, it need not be uniform.

The relationship and effects of the electrostatic fields described above with a non-Z-planar interface therebetween cooperate in a tube 10 that can be shorter in depth than a conventional plural-beam CRT and yet operates at a comparable deflection yoke power level or that can employ a conventional CRT funnel and faceplate and yet operate with a smaller, more efficient deflection yoke, as may be desirable and convenient.

The particular bias potentials are selected to obtain, for example, a suitable balance of reduced tube depth and reasonable yoke power in consideration of the effects of each of the bias potentials. For example, as the bias potential $V_{44}$ of the ultor of gun 12 of a particular physical-size tube 10 is increased, the required deflection power of yoke 16 tends to increase, indicating that the $V_{44}$ bias potential should be selected in conjunction with selection of the location of gap 45. Bias potentials $V_{22}$ and $V_{44}$ should be kept below the potential at which X-rays that could penetrate the envelope of tube 10 could be generated, i.e. below about 35 kV. Suitable bias potentials may be applied via one or more standard high-voltage feed-through connections or "buttons" penetrating the glass wall of tube funnel 40.

Figure 5:
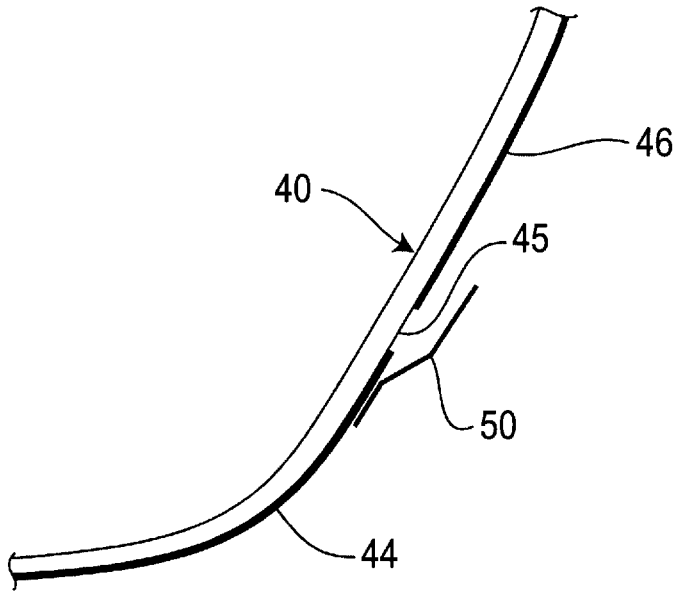
FIG. 5 is a detail cross-sectional schematic diagram illustrating the region of the gap between the conductive electrodes of the exemplary cathode ray tube of FIGS. 3 and 4.

FIG. 5 is a detail cross-sectional schematic diagram illustrating the region of the gap 45 between the conductive electrodes 44, 46 of the exemplary plural-beam cathode ray tube 10 of FIGS. 3 and 4. While gap 45 may simply be a space between conductive coatings 44 and 46, such space of exposed dielectric material, i.e., the glass of tube funnel 40, may accumulate charge that may distort or otherwise adversely affect the desired electrostatic fields. Gap 45 is shielded by a conductive shield 50 that is electrically connected to one of conductive coatings 44, 46 to block electrons from reaching the dielectric material of tube funnel 40. Shield 50 preferably substantially covers gap 45 in that there is no clear or unobstructed straight-line path between the surface of tube funnel 40 exposed in gap 45 and screen 22.

Typically, conductive shield 50 is a sheet metal structure that is held in position against conductive coating 44 by a suitable adhesive or glass frit, or by mechanical clips, glass tabs and other features on the interior surface of funnel 40, or by other suitable means. Metal shield 50 is typically formed of sheet metal such as steel, stainless steel, Invar or Kovar alloy or other nickel-iron alloy, titanium, and the like. Alternatively, gap 45 may be filled with a high-resistivity material so as to avoid charge build up or by a resistive material for setting the bias potential on conductive coating 44, such as by resistive voltage division of the screen bias potential on conductive coating 46.

Plural-beam tube 10 according to the invention is also advantageous because it "looks like a conventional CRT" with a conventionally-shaped glass bulb and neck, and a planar or slightly curved faceplate, and so can utilize the same manufacturing processes as are utilized for conventional CRTs, or plural-beam tube 10 may employ a conventional CRT tube funnel and faceplate. The issues of space charge effects expanding the electron beam are also similar to those in conventional CRTs and so the spot size variation with a smaller spot at the center of the faceplate and a somewhat larger spot size at the edges and corners is similar to that of the conventional CRT, although the structure and operation of tube 10 is different therefrom.

As used herein, "generally rectangular shape" or "substantially rectangular" refers to a shape somewhat reflective of the shape of faceplate 20 and/or the cross-section of tube envelope 40 when viewed in a direction along Z axis 13. As used herein, a generally rectangular shape includes rectangles and squares, and rectangles and squares having rounded corners and/or concave and/or convex sides, so as to be suggestive of or be racetrack shapes, oval shapes, elliptical shapes and the like. Electrodes 44, 46 may be oval or even almost circular in cross-section, particularly where the cross-section of tube envelope 40 is of such shape, as is often the case at the rearward portions thereof, such as those proximate tube neck 14 and yoke 16.

Figure 6:
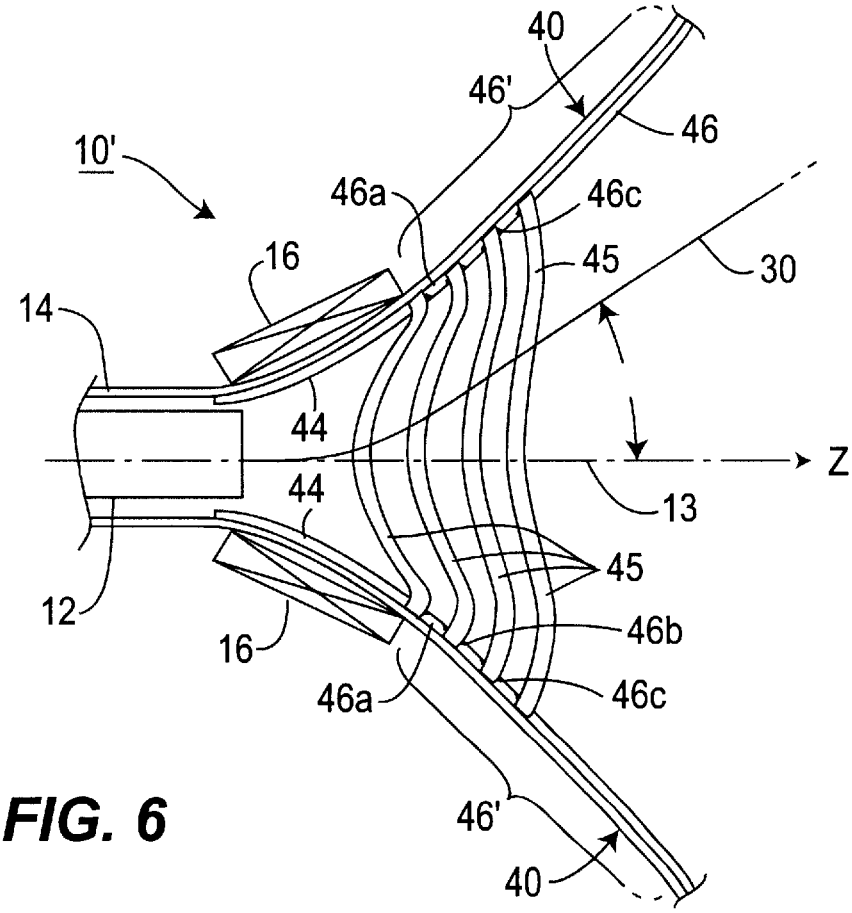
FIG. 6 is a cross-sectional diagram of the yoke deflection region of an alternative embodiment of a cathode ray tube in accordance with the invention.

FIG. 6 is a cross-sectional diagram of the yoke deflection region of an alternative embodiment of a plural-beam cathode ray tube 10' in accordance with the invention in which electrode 46 of tube 10 is replaced by an alternative electrode 46' comprising a plurality of electrodes each having a particular value of bias potential applied thereto. Electrode 46' includes, for example, a main conductive coating electrode 46 and three generally narrow conductive coating electrodes 46*a*, 46*b*, and 46*c*, spaced apart along a section of tube funnel 40 at gap 45 forward of gun 12, tube neck 14 and magnetic deflection yoke 16. Plural electron beams 30 exit gun 12 directed towards faceplate 20 (not visible) and are magnetically deflected by an angle $\alpha$, typically up to an angle of ±55° with respect to Z axis 13 with a conventional yoke 16 for a 110° tube.

It is noted that electrode 46, whether a single electrode 46 or plural sub-electrodes 46*a*, 46*b*, . . . , tends to either increases the efficiency of deflection yoke 16 or facilitate deflection of the plural electron beams 30 beyond the deflection that would otherwise be produced by deflection yoke 16.

In tube 10' the electrodes 46*a*–46*c* are preferably biased at different relatively high positive potentials intermediate the screen potential on conductive coating 46 and the bias potential on conductive coating 44 so as to more precisely shape the potential characteristic in the region of gap 45 while not accelerating the electrons of electron beam 30 towards faceplate 20 as quickly as does the screen potential. Each of electrodes 46*a*–46*c* is preferably a ring electrode proximate tube funnel 40 and typically surrounding Z axis 13 along which is electron gun 12. Typical bias potentials for electrodes 46*a*–46*c* are, for example, 19 kV, 23 kV, and 27 kV, respectively, with gun 12 and electrode 44 biased to about 15 kV and screen electrode 22 (not visible) and electrode 46 biased to 30 kV. Conductive coatings 44, 46 and 46*a*–46*c* are preferably a deposited metal such as aluminum, graphite, carbon or iron oxide.

The shaped conductive coatings 44, 46, and shaped conductive strips 46*a*–46*c*, if employed, can be deposited with a series of metal sublimation filaments and a deposition mask that is molded to fit snugly against the glass wall of tube funnel 40. Strips 46*a*, 46*b*, . . . need only be a few millimeters wide and a few microns thick, being separated by a small gap, e.g., a gap of 1–2 mm, so as to minimize charge buildup on the glass of tube funnel 40. Deposited conductive strips 46*a*, 46*b*, . . . are on the surface of glass tube funnel 40 thereby maximizing the interior volume thereof through which electron beam 30 may be directed.

Although bias potential could be applied to each of strips 46*a*, 46*b*, . . . by a separate conductive feedthrough, having too large a number of feedthroughs could weaken the glass structure of tube funnel 40. A vacuum-compatible resistive voltage divider can be employed within the vacuum cavity formed by tube funnel 40 and faceplate 20, and located in a position shielded from electron gun 12. One form of suitable resistive voltage divider may be provided by high-resistivity material on the interior surface of glass tube envelope 40, such as by spraying or otherwise applying such coating material thereto, such as in the gaps 45 between coatings 44, 46, 46*a*–46*c*. Suitable coating materials include, for example, ruthenium oxide, and preferably exhibit a resistance is in the range of $10^8$ to $10^{10}$ ohms. The high-resistivity coating is in electrical contact with the metal electrodes 44, 46, and 46*a*–46*c* for applying bias potential thereto. The thickness and/or resistivity of such coating need not be uniform, but may be varied to obtain the desired bias potential profile. Alternatively, and beneficially, so varying such resistive coating may be utilized for controllably shaping the profile of the bias potential over the region of gap 45 on the interior surface of tube envelope 40. Thus, the complexity of the structure of electrodes 44, 46, and/or 46*a*–46*c* may be simplified and the number of conductive feedthroughs penetrating tube envelope 40 may be reduced. In addition, such high-resistivity coating may be applied in the gaps between electrodes, such as electrodes 44, 46, 48 to prevent the build up of charge due to electrons impinging thereat.

Figure 7A:
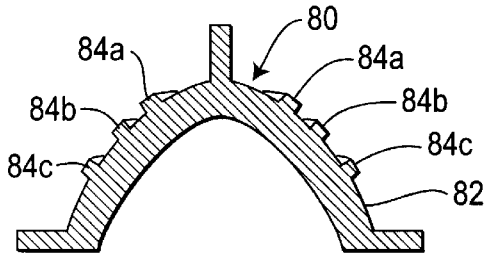
FIGS. 7A–7D are cross-sectional schematic diagrams showing a method of forming an electrode structure in a cathode ray tube according to the invention.
Figure 7B:
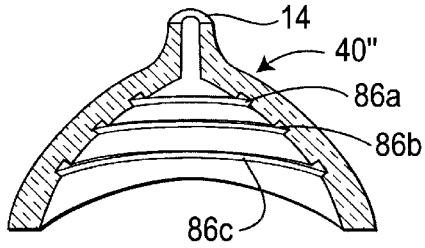
Figure 7C:
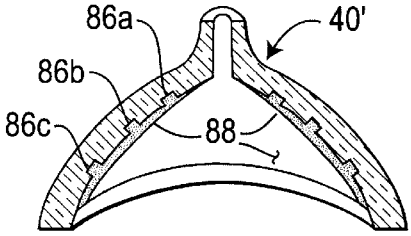
Figure 7D:
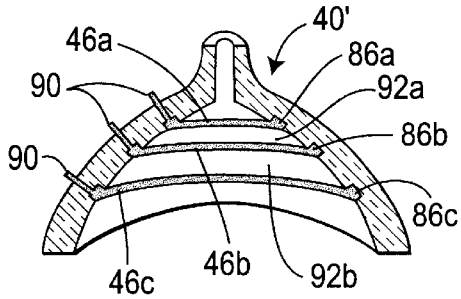

An alternative to the masked deposition of metal strips 46*a*, 46*b*, . . . described above, the process illustrated in simplified form in FIGS. 7A–7D can be utilized. A mold 80 has an outer surface 82 that defines the shape of the inner surface of the funnel-shaped glass bulb 40' of a cathode ray tube 10 and has raised patterns 84*a*, 84*b*, 84*c* thereon defining the reverse of the size and shape of the metal strips 46*a*, 46*b*, 46*c*, as shown in FIG. 7A. Upon removal from mold 80, glass bulb 40' has a pattern of grooves 86*a*, 86*b*, 86*c* in the inner surface thereof of the size and shape of the desired metal stripes 46*a*, 46*b*, 46*c*, as shown in FIG. 7B. Next, metal such as aluminum is deposited on the inner surface of glass bulb 40' sufficient to fill grooves 86*a*, 86*b*, 86*c*, as shown in FIG. 7C. Then, the metal 88 is removed, such as by polishing or other abrasive or removal method, to leave metal strips 46*a*, 46*b*, 46*c* in grooves 86*a*, 86*b*, 86*c*, respectively, of glass bulb 40, with gaps 45 therebetween, as shown in FIG. 7D. Conductive feedthroughs 90 provide external connection to metal strip electrodes 46*a*, 46*b*, 46*c* through glass bulb 40'. Optionally, high resistivity material may be applied as a coating in the gaps 92*a*, 92*b*, between electrodes 46*a*, 46*b*, 46*c*.

Figure 8A:
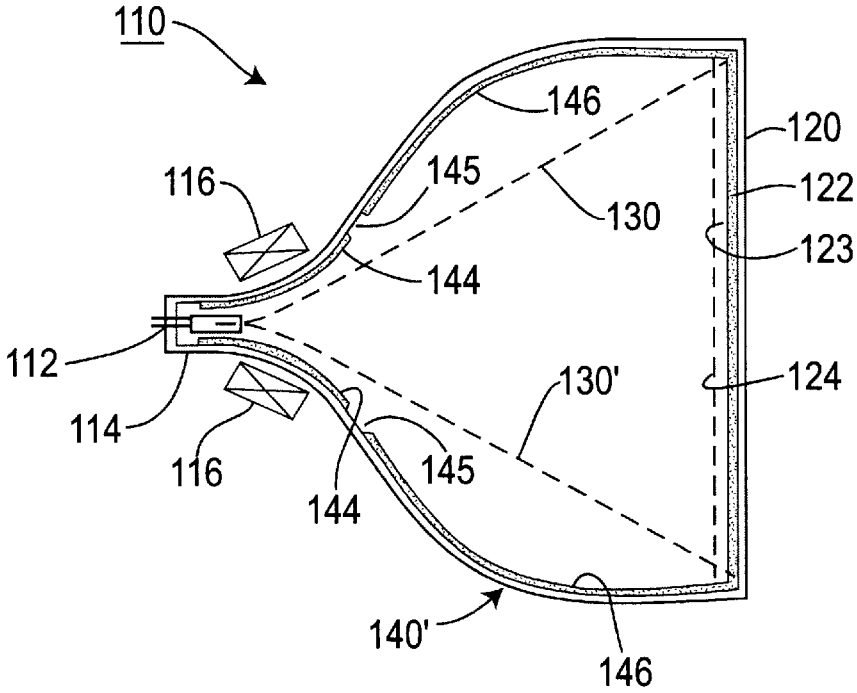
FIGS. 8A and 8B are cross-sectional diagrams of an embodiment of a cathode ray tube according to the invention in a conventional-size CRT enclosure and in a reduced-depth CRT enclosure, respectively.
Figure 8B:
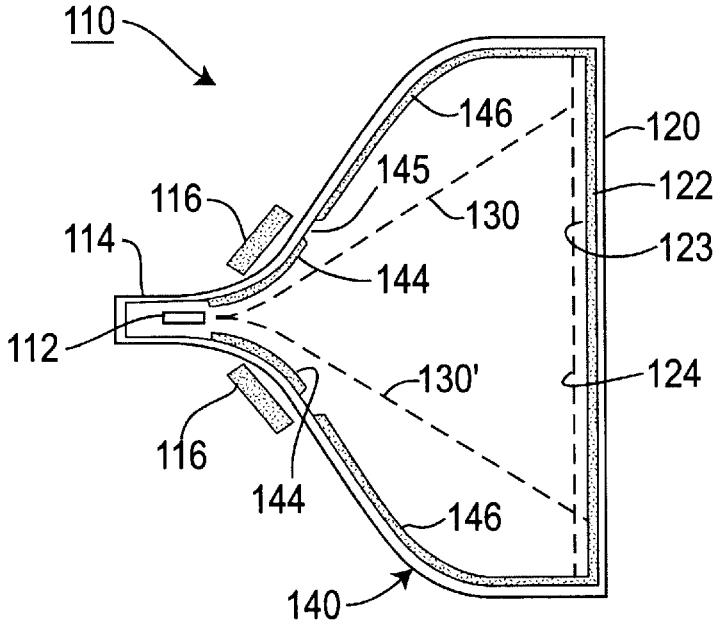

FIGS. 8A and 8B are cross-sectional diagrams of an embodiment of plural-beam cathode ray tube 110 according to the invention in a conventional CRT glass tube envelope 140' and in a reduced-depth CRT envelope 140, respectively, both of which operate in like manner. Neck electrode 144 located proximate to and surrounding neck 114 of cathode ray tube 110 is biased to a potential less than the screen potential to which screen electrode 122 is biased. Electrode 146, which is separated from electrode 144 by gap 145, is biased at screen potential, such as by contacting screen electrode 122. Gap 45 may be either insulating or resistive as when bridged by a high-resistivity coating. Plural electron beams 130 produced by electron gun 112 in tube neck 114 are deflected by magnetic deflection yoke 116 over a range of angles represented by the dashed lines 130, 130' to scan an area of faceplate 120 and the phosphor(s) 123 thereon. Electrodes 144 and 146 are preferably of metal on the interior surface of tube bulb 140, 140' such as by a spray or deposition of aluminum, graphite, carbon or iron oxide.

Cathode ray tube 110 may be referred to as a "bi-potential tube" because it operates at two different bias potentials, i.e. screen potential, typically 30 kV, on screen electrode 122 and conductive coating 146, and a lesser potential, typically 15–20 kV, on conductive coating neck electrode 144 in the region of neck 114 and yoke 116. The result of the bi-potential tube aspect of the invention is that the cooperation between the magnetic deflection and the electrostatic field produced by the bias potential of neck electrode 144 and the shaping of the gap 145 separating conductive coatings 44, 46, i.e. the electrons of the electron beam being slower moving and therefore more easily deflected by yoke 116. The result of this cooperation may be utilized to realize either a substantial reduction of yoke power with only a slight reduction of the deflection angle, and therefore a smaller, lighter, less expensive and likely more reliable deflection yoke 116, or a greater deflection angle with the same yoke power, or operation at a higher horizontal "line rate" or scanning frequency. In the latter case, it may be desirable to reduce the size of the glass tube envelope 140 as depicted in FIG. 8B from that of the conventional envelope 140' of FIG. 8A. In either case, spot size is not increased and the deflected electron beam travels thereafter in a straight trajectory to faceplate 120.

An advantage of the bi-potential tube arrangement is that by a relatively simple modification of the conventional CRT by adding neck electrode 144 and a potential feedthrough therefor and insulating gap 145, existing glass tube bulbs 140' and processing may be utilized in making cathode ray tubes having performance advantages. This is of particular benefit to the makers of computer monitor tubes, projection tubes, color television tubes and the like. Alternatively, the depth of tube envelope 140 may be reduced as a result of the increased deflection produced by yoke 116 in cooperation with the electric field of neck electrode 144.

Figure 9:
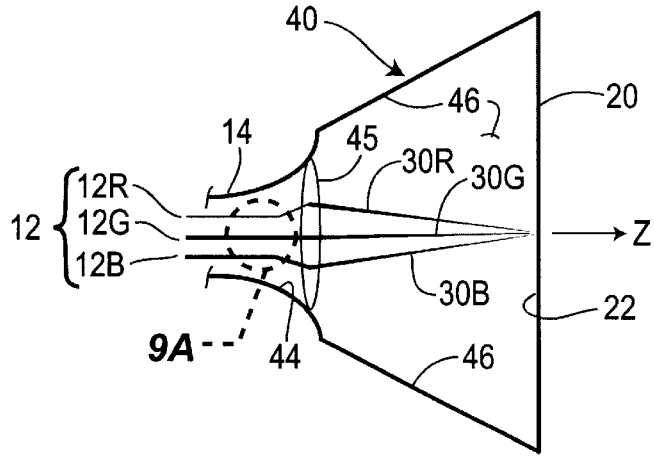
FIGS. 9 and 10 are cross-sectional schematic diagrams illustrating alternative electron gun arrangements useful in relation to the cathode ray tube according to the present invention.
Figure 9A:
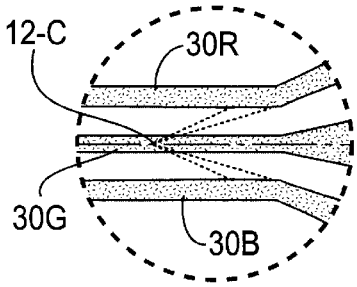
Figure 10:
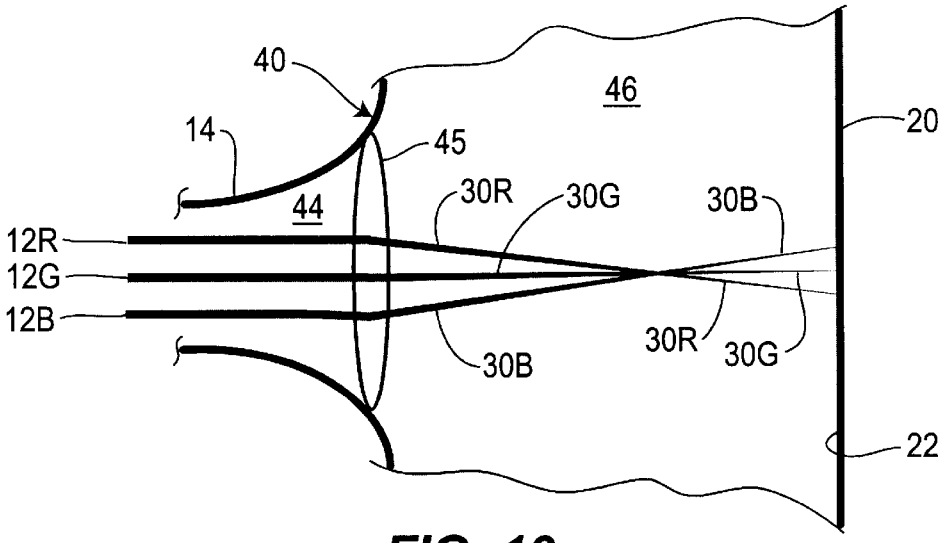

FIGS. 9 and 10 are cross-sectional schematic diagrams illustrating alternative electron gun arrangements useful in relation to the plural-beam cathode ray tube 10 according to the invention. The spot size and convergence of the plural electron beams 30 is controlled by the particular electron gun and the convergence of the desired yoke 16. In particular, for a three-beam tube 10 for producing color images, the electrostatic lens in tube funnel 40 formed by conductive coatings 44, 46 are wide open, albeit a weak lens, and has no individual apertures for any of the three individual beams as could provide focusing and convergence of the three beams. Beams entering this open electrostatic lens 44, 46 from electron gun 12 will achieve focus and convergence if they emanate from electron gun 12 as if they originated at the same point in space, i.e., the same point within electron gun 12.

As illustrated in FIG. 9, electron beams 30R, 30G, 30B appear to have originated at common point 12-C within electron gun 12 even though they originate as parallel beams from three in-line electron sources 12R, 12G, 12B, respectively. Such electron gun 12 in conjunction with an anastigmatic deflection yoke 16 will effectively produce electron beams 30R, 30G, 30B that have a high degree of self convergence across the area of screen 22 and that are also in focus. Asymmetries, if any, between the two outer beams 30R, 30B, may be reduced or compensated by applying measured amounts of higher-order harmonics of the yoke drive signal to anastigmatic deflection yoke 16. Alternatively, dynamic magnetic and/or electric fields may be utilized to provide astigmatism that converges and focuses the three electron beams 30R, 30G, 30B.

Typically, deflection yoke 16 is a non-self-converging deflection yoke similar to the yokes utilized in conventional television receivers. Yoke 16 may be shorter in the Z-axis direction than a conventional yoke where the CRT 10 with which it is employed is of reduced depth (reduced Z-axis dimension).

Alternatively, the video signals applied to the electron gun cathodes to modulate each beam of electrons 30R, 30G, 30B may be processed through a one-dimensional or a two-dimensional frame store so as to be delayed an appropriate time as a function of the position in the image, i.e. the position on the raster-scanned screen. In this case, it is not necessary to attempt to converge the beams at the center of screen 22, and the common electrostatic lens 44, 46 will produce over-focused beams 30R, 30G, 30B as illustrated in FIG. 10. In this arrangement, electron gun 12 preferably is arranged to produce the best and smallest spot for each of electron beams 30R, 30G, 30B, and preferably includes appropriate dynamic astigmatism grids to maintain spot size as the electron beams 30R, 30G, 30B are deflected across screen 22 by deflection yoke 16.

To the extent convergence error needs to be corrected at any particular location(s) on screen 22, convergence is corrected either (a) by processing the red, green, blue (R, G, B) video signals, as a function of their X (horizontal) position on screen 22 or of their Y (vertical) position on screen 22, or both, or (b) by delaying the video signals appropriately where the three electron beams 30R, 30G, 30B all travel along the same trajectory across screen 22, i.e. as where deflection yoke 16 and/or the geometry of conductive coatings 44, 46 are specifically arranged for such result.

Further alternatives include, but are not limited to, providing auxiliary or supplemental magnetic deflection fields such as by including auxiliary or supplemental windings in deflection yoke 16 and/or applying tailored dynamic drive signals that vary as a function of beam position on the area of screen 22 thereto. The foregoing may be employed individually or in combination of one or more of the described techniques. For example, the combination of developing dynamic magnetic fields in deflection yoke 16 may be provided either by providing auxiliary windings or by providing dynamic electromagnetic drive signals, or both. Further, providing a dynamic magnetic field may be employed in conjunction with also providing dynamic electric fields such as by applying dynamic electrical signals to various grids of electron gun 12.

In any of the embodiments described herein, the conductive coatings or electrodes on the surface of the tube envelope, such as a faceplate 20, 120 and tube envelope 40, 140 are preferably a sprayed, sublimated, spin coated or other deposition or application of graphite or carbon-based materials, iron oxide, aluminum or aluminum oxide or other suitable conductive material. Where shielding structures are utilized, such as shield structure 50 and the clips and supports for shadow mask 24, such structures are preferably formed of a suitable metal such as a titanium, Invar alloy, steel, stainless steel, or other suitable metal and may be bonded to tube envelope 40 or embedded into a glass feature thereof for mechanical support.

While the present invention has been described in terms of the foregoing exemplary embodiments, variations within the scope and spirit of the present invention as defined by the claims following will be apparent to those skilled in the art. For example, the gap 45 between the two conductive coatings 44, 46, could be filled with a sprayed on or otherwise deposited resistive material providing a voltage dropping resistance for reducing the screen potential on conductive coating 46 to the lower bias potential on conductive coating 44.

In addition, the shadow mask having a pattern of apertures corresponding to the pattern of color phosphors described herein may be a shadow mask, a focus mask or any other patterned structure through which electrons pass to impinge upon the color phosphors. If a higher efficiency shadow mask is available, such as a shadow mask that enables a larger proportion of the electrons of electron beam to pass through the apertures thereof, such high-efficiency shadow mask could be employed in cathode ray tubes of the present invention, thereby resulting in one or more of increased brightness, reduced spot size or reduced gun diameter (and the benefit of increased deflection angle or reduced yoke power associated therewith).

Bias potentials developed by voltage dividers may be developed by resistive voltage dividers formed of discrete resistors, blocks of high-resistivity material, coatings of high-resistivity material and other suitable voltage dividers, whether internal or external to tube funnel 40.

What is claimed is:

1. A plural-beam tube comprising:

a tube envelope having a faceplate and a screen electrode on the faceplate adapted to be biased at a screen potential;

a source of at least two beams of electrons directed toward said faceplate, wherein said source is adapted for magnetic deflection of said at least two beams of electrons;

phosphorescent material disposed on said faceplate for producing light in response to the at least two beams of electrons impinging thereon; and at least first and second electrostatic electrodes on an interior surface of said tube envelope and defining a non-Z-planar gap therebetween, wherein said first electrode is proximate said source and adapted to be biased at a potential less than the screen potential, and wherein said second electrode is between said first electrode and said screen electrode and is adapted to be biased at the screen potential.

2. The plural-beam tube of claim 1 wherein said first and second electrodes include conductive material on an interior surface of said tube envelope defining the non-Z-planar gap therebetween on the interior surface.

3. The plural-beam tube of claim 1 further including at least one of (i) an electrical connection of said second electrode to said screen electrode and (ii) an electrical conductor penetrating said tube envelope and connected to at least one of said first and second electrodes.

4. The plural-beam tube of claim 1 further comprising a conductive shield proximate the interior of said tube envelope and substantially covering the non-Z-planar gap.

5. The plural-beam tube of claim 4 wherein said conductive shield includes one of a metal shield and an high-resistivity material on the interior surface of said tube envelope.

6. The plural-beam tube of claim 1 wherein the non-Z-planar gap is one of elongated, substantially elliptical, oval, racetrack-shaped, and substantially rectangular, when viewed from said faceplate.

7. The plural-beam tube of claim 1 wherein said faceplate is substantially rectangular having a longer dimension and a shorted dimension, and wherein the non-Z-planar gap is elongated in the direction of said longer dimension when viewed from said faceplate.

8. The plural-beam tube of claim 1 further comprising a resistance within said tube envelope and adapted for receiving a bias potential for developing at least one of the potentials at which said first and second electrodes are adapted to be biased.

9. The plural-beam tube of claim 8 wherein said resistance includes a high-resistivity coating on the interior surface of said tube envelope.

10. The plural-beam tube of claim 1 further comprising a shadow mask proximate said faceplate having a plurality of apertures therethrough, said shadow mask adapted to be biased at the screen potential, and wherein said phosphorescent material includes a pattern of different phosphorescent materials on said faceplate that emit different color light in response to the at least two beams of electrons impinging thereon through the apertures of said shadow mask.

11. The plural-beam tube of claim 1 wherein the source of at least two beams of electrons directs the at least two beams of electrons in directions toward said faceplate so that the at least two beams of electrons appear to emanate from a common point.

12. A bi-potential cathode ray tube comprising:

a tube envelope having a generally flat faceplate and a screen electrode on the faceplate adapted to be biased at a screen potential, and having a tube neck opposite said faceplate;

in said tube neck, a source of at least two beams of electrons directed toward said faceplate, wherein said source is adapted for magnetic deflection of said at least two beams of electrons;

a deflection yoke around said tube neck for deflecting the at least two beams of electrons from said source over a predetermined range of deflection angles, whereby the deflected at least two beams of electrons impinge upon a given area of the screen electrode;

phosphorescent material disposed on said faceplate for producing light in response to the beam of electrons impinging thereon; and at least first and second electrostatic electrodes interior said tube envelope and defining a non-Z-planar gap therebetween, wherein said first electrode is proximate said source and adapted to be biased at a potential less than the screen potential, and wherein said second electrode is between said first electrode and said screen electrode and is adapted to be biased at said screen potential.

13. The cathode ray tube of claim 12 further comprising a shadow mask proximate said faceplate having a plurality of apertures therethrough, said shadow mask adapted to be biased at said screen potential, and wherein said phosphorescent material includes a pattern of different phosphorescent materials that emit different respective colors of light in response to said at least two beams of electrons impinging thereon.

14. The cathode ray tube of claim 12 wherein said first electrode includes conductive material on an interior surface of said tube envelope proximate said neck and said second electrode includes conductive material on the interior surface of said tube envelope extending proximate said screen electrode.

15. The cathode ray tube of claim 12 further including one of a metal shield and a high-resistivity material covering the non-Z-planar gap between the first and second electrodes.

16. A display comprising:

a tube envelope having a faceplate and a screen electrode on the faceplate biased at a screen potential;

a source within said tube envelope of at least one beam of electrons directed toward said faceplate;

a deflection yoke proximate said source of at least one beam of electrons for magnetically deflecting said at least one beam of electrons, said deflection yoke defining a deflection plane;

phosphorescent material disposed on said faceplate for producing light in response to the at least one beam of electrons impinging thereon;

at least first and second electrostatic electrodes interior said tube envelope defining a gap therebetween that intersects the deflection plane and is partly disposed on one side thereof and partly to the other side thereof, wherein said first electrode is proximate said source of at least one beam of electrons and biased at a potential less than the screen potential, and wherein said second electrode is between said first electrode and said screen electrode and is biased at said screen potential; and a source of potential providing the first and screen potentials.

17. The display of claim 16 wherein said first and second electrodes include conductive material on an interior surface of said tube envelope defining the gap between said first and second electrodes.

18. The display of claim 16 further including one of a metal shield and a high-resistivity material covering the gap between the first and second electrodes.

19. The display of claim 16 wherein said faceplate is substantially rectangular having a longer dimension and a shorted dimension, and wherein the non-Z-planar gap is elongated in the direction of said longer dimension when viewed from said faceplate.

20. The display of claim 16 wherein the gap is one of elongated, substantially elliptical, oval, racetrack-shaped, and substantially rectangular, when viewed from said faceplate.

21. The display of claim 16 further including at least one of (i) an electrical connection of said second electrode to said screen electrode and (ii) an electrical conductor penetrating said tube envelope and connected to at least one of said first and second electrodes.

22. The display of claim 16 wherein the source of at least one beam of electrons provides at least two beams of electrons directed in directions toward said faceplate so that the at least two beams of electrons appear to emanate from a common point, wherein said deflection yoke is one of an anastigmatic deflection yoke and a non-astigmatic deflection yoke producing dynamic magnetic fields tending to converge and focus the at least two beams of electrons.

23. The display of claim 16 further comprising a shadow mask proximate said faceplate having a plurality of apertures therethrough and biased at the screen potential, and wherein said phosphorescent material includes a pattern of different phosphorescent materials on said faceplate that emit different color light in response to the beam of electrons impinging thereon through the apertures of said shadow mask.

24. A tube comprising:

a tube envelope having a faceplate and a screen electrode on the faceplate adapted to be biased at a screen potential;

a source of at least one beam of electrons directed toward said faceplate, wherein said source is adapted for magnetic deflection of said at least one beam of electrons;

phosphorescent material disposed on said faceplate for producing light in response to the at least one beam of electrons impinging thereon; and at least first and second electrostatic electrodes on an interior surface of said tube envelope and defining an elongated non-Z-planar gap therebetween, wherein said first electrode is proximate said source and adapted to be biased at a potential less than the screen potential, and wherein said second electrode is between said first electrode and said screen electrode and is adapted to be biased at the screen potential.

25. The tube of claim 24 wherein said first and second electrodes include conductive material on an interior surface of said tube envelope defining the elongated non-Z-planar gap therebetween on the interior surface.

26. The tube of claim 24 further comprising a conductive shield proximate the interior of said tube envelope and substantially covering the non-Z-planar gap.

27. A bi-potential cathode ray tube comprising:

a tube envelope having a generally flat faceplate forward and a screen electrode on the faceplate adapted to be biased at a screen potential, and having a tube neck rearward opposite said faceplate;

in said tube neck, a source of at least one beam of electrons directed forward toward said faceplate, wherein said source is adapted for magnetic deflection of said at least one beam of electrons;

a deflection yoke around said tube neck for deflecting the at least one beam of electrons from said source over a predetermined range of deflection angles, whereby the deflected at least one beam of electrons impinge upon a given area of the screen electrode, said deflection yoke defining a forward deflection plane;

phosphorescent material disposed on said faceplate for producing light in response to the beam of electrons impinging thereon; and at least first and second electrostatic electrodes interior said tube envelope and defining a gap therebetween, wherein said first electrode is rearward proximate said source and adapted to be biased at a potential less than the screen potential, wherein said second electrode is forward between said first electrode and said screen electrode and is adapted to be biased at said screen potential, and wherein the gap is partly forward and partly rearward of the forward deflection plane.

28. The bi-potential tube of claim 27 wherein said first electrode includes conductive material on an interior surface of said tube envelope proximate said neck and said second electrode includes conductive material on the interior surface of said tube envelope extending proximate said screen electrode.

29. The bi-potential tube of claim 27 further including one of a metal shield and a high-resistivity material covering the gap between the first and second electrodes.

30. The bi-potential tube of claim 27 wherein the source of at least one beam of electrons provides at least two beams of electrons directed in directions toward said faceplate so that the at least two beams of electrons appear to emanate from a common point, wherein said deflection yoke is one of an anastigmatic deflection yoke and a non-astigmatic deflection yoke producing dynamic magnetic fields tending to converge and focus the at least two beams of electrons.

31. A plural-beam tube comprising:

a tube envelope having a faceplate and a screen electrode on the faceplate adapted to be biased at a screen potential, said tube envelope defining an axis and a plane perpendicular to the axis;

a source of at least two beams of electrons directed generally along the axis toward said faceplate, wherein said source is adapted for magnetic deflection of said at least two beams of electrons away from the axis;

phosphorescent material disposed on said faceplate for producing light in response to the at least two beams of electrons impinging thereon; and at least first and second electrostatic electrodes on an interior surface of said tube envelope and each having an edge defining a gap therebetween on the interior surface of said tube envelope, wherein said first electrode is proximate said source and adapted to be biased at a potential less than the screen potential, and wherein said second electrode is between said first electrode and said screen electrode and is adapted to be biased at the screen potential, and wherein a portion of the edge of each of the at least first and second electrodes is disposed closer toward the faceplate than the plane perpendicular to the axis and another portion of the edge of each of the at least first and second electrodes is disposed closer toward the source than the plane perpendicular to the axis.

32. A bi-potential cathode ray tube comprising:

a tube envelope having a generally flat faceplate and a screen electrode on the faceplate adapted to be biased at a screen potential, and having a tube neck opposite said faceplate, said tube envelope defining a central axis extending from the tube neck to the faceplate, and defining a given plane perpendicular to the central axis;

in said tube neck, a source of at least two beams of electrons directed generally in a direction along the central axis toward said faceplate, wherein said source is adapted for magnetic deflection of said at least two beams of electrons;

a deflection yoke around said tube neck for deflecting the at least two beams of electrons from said source over a predetermined range of deflection angles, whereby the deflected at least two beams of electrons impinge upon a given area of the screen electrode;

phosphorescent material disposed on said faceplate for producing light in response to the beam of electrons impinging thereon; and at least first and second electrostatic electrodes interior said tube envelope and having respective edges defining a gap therebetween, wherein said first electrode is proximate said source and adapted to be biased at a potential less than the screen potential, and wherein said second electrode is between said first electrode and said screen electrode and is adapted to be biased at said screen potential, and wherein a portion of the edge of each of the at least first and second electrostatic electrodes is disposed closer toward the faceplate than the given plane and another portion of the edge of each of the at least first and second electrodes is disposed closer toward the source than the given plane.

33. A tube comprising:

a tube envelope having a faceplate and a screen electrode on the faceplate adapted to be biased at a screen potential;

a source of at least one beam of electrons directed generally along a tube axis toward said faceplate, wherein said source is adapted for magnetic deflection of said at least one beam of electrons;

phosphorescent material disposed on said faceplate for producing light in response to the at least one beam of electrons impinging thereon; and first and second electrostatic electrodes on an interior surface of said tube envelope and having respective edges defining an elongated gap therebetween, wherein said first electrode is proximate said source and adapted to be biased at a potential less than the screen potential, and wherein said second electrode is between said first electrode and said screen electrode and is adapted to be biased at the screen potential, and wherein a portion of the edge of each of the first and second electrostatic electrodes is disposed closer toward the faceplate than a given plane that is perpendicular to the tube axis and another portion of the edge of each of the first and second electrodes is disposed closer toward the source than the given plane.

* * * * *